US006412552B1

(12) United States Patent
Rooks

(10) Patent No.: US 6,412,552 B1
(45) Date of Patent: Jul. 2, 2002

(54) CABLE PROTECTOR

(75) Inventor: Alvin Rooks, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 58 days.

(21) Appl. No.: 09/704,944

(22) Filed: Nov. 2, 2000

(51) Int. Cl.[7] ..... E21B 19/22

(52) U.S. Cl. ..... 166/77.1; 166/75.14

(58) Field of Search ..... 166/75.14, 75.15, 166/77.1, 85.1, 98, 99, 241.5; 294/132, 133

(56) References Cited

U.S. PATENT DOCUMENTS

| | | | | |
|---|---|---|---|---|
| 2,262,364 A | * | 11/1941 | Hugel et al. | 15/104.33 |
| 4,515,211 A | * | 5/1985 | Reed et al. | 166/385 |
| 5,973,270 A | * | 10/1999 | Keller | 174/136 |
| 6,247,534 B1 | * | 6/2001 | Newman | 166/385 |

* cited by examiner

*Primary Examiner*—David Bagnell
*Assistant Examiner*—Brian Halford
(74) *Attorney, Agent, or Firm*—Adenike Adewuya; Wayne I. Kanak

(57) ABSTRACT

A cable protector includes a housing body which is adapted to fit in a pipe connector. The housing body has a central bore and an insert body is rotatably supported in the central bore. The insert body has a groove which is adapted to receive a cable.

10 Claims, 6 Drawing Sheets

CABLE PROTECTOR

BACKGROUND OF THE INVENTION

1. Field of the Invention

The invention relates generally to oil and gas wireline operations. More specifically, the invention relates to an apparatus for protecting a wireline from damage during a fishing operation.

2. Background Art

In oil and gas wireline operations, downhole tools, e.g., logging tools, are conveyed into and withdrawn from a wellbore using an armored electrical cable called a wireline. The downhole tools are typically tubular members that are threaded together to form a "tool string." A cable head couples the wireline to the tool string. Occasionally, during operation, the tool string may become stuck in the wellbore. When the tool string gets stuck, a high tension is usually applied to the tool string to try to free the tool string from its stuck position. This high tension is applied to the wireline at the surface by a winch used to extend and retract the cable, and the wireline transmits the applied tension to the cable head. The cable head in turn transmits the tension to the tool string. The amount of tension available to free the tool string from its stuck position depends on the breaking strength of the cable, the profile and coefficient of friction of the wellbore, the position of the tool string inside the wellbore, and various other parameters, in particular the weight of the cable in the wellbore.

The connection between the cable head and the wireline typically includes a "weak point." A weak point is a link designed to break when a predetermined amount of tension is applied to it. Normally, the weak point has the lowest breaking strength in the tool string. The weak point allows the cable to be separated from the cable head in the event that enough tension cannot be applied to the tool to free it. In situations where the tension required to free the tool string exceeds the breaking strength of the cable, the tool string must be "fished" out of the wellbore. To fish the tool string, the operator first latches onto the cable head or tool string using a fishing tool coupled to one end of a drill pipe and then applies tension to the wireline to break the weak point and release the wireline from the cable head. The wireline is first removed from the wellbore, and then the cable head and the tool string are pulled out of the wellbore by removing the drill pipe.

In a method of fishing known as the cut and thread method, the cable is used to guide the fishing tool to the stuck tool string. FIG. 1 shows a prior art setup from the rig floor up for a fishing operation. During normal wireline operations, the cable 2 is payed from a cable drum (not shown). The cable 2 is threaded through sheaves 4, 6 and then passed through the rotary table 8 into the wellbore (not shown). In order to allow the cable 2 to guide the fishing tool (not shown) to the stuck tool (not shown) in the wellbore (not shown), the cable 2 is cut near the rig floor. An overshot 10 is connected to the winch-side section 2*a* of the cable 2 threaded through the sheaves 4, 6, and a spearhead 12 is connected to the downhole-side section 2*b* of the cable 2 that extends through the rotary table 8. In the illustration shown, a drill pipe 14 is supported by slips (not shown) in the rotary table 8. The fishing tool (not shown) is attached to the end of this drill pipe 14. A clamp 15 is then mounted on the upper end of the drill pipe 14 to hold the spearhead 12 and prevent the spearhead 12 from falling through the drill pipe 14.

The next step is to make up a drill pipe stand 16 and then connect the drill pipe stand 16 to the drill pipe 14. Typically, the drill pipe stand 16 consists of three drill pipe "joints" threaded together. After connecting the drill pipe stand 16 to the drill pipe 14, the drill pipe stand 16 is lowered through the rotary table 8 into the wellbore (not shown). This process of connecting a drill pipe stand to the uphole end of the drill pipe at the rotary table 8 and lowering the drill pipe stand through the rotary table 8 is repeated until the fishing tool (not shown) on the end of the drill pipe 14 reaches the stuck tool (not shown) in the wellbore (not shown). In the illustration, a drill pipe stand 16 is suspended above the drill pipe 14 by a power drive 18. The power drive 18 is supported by the derrick 20 and rides on the guide rail 22. Before connecting the drill pipe stand 16 to the drill pipe 14, the winch-side cable section 2*a* is threaded through the drill pipe stand 16 until the overshot 10 engages with the spearhead 12. After the tension on the cable 2 is increased, the clamp 15 is then removed to allow the drill pipe stand 16 to be connected to the drill pipe 14. The power drive 18 is used to lower the drill pipe 14 having the new stand 16 connected thereto.

FIG. 2 shows the drill pipe stand 16 connected to the drill pipe 14. To connect the drill pipes, the drill pipe stand 16 is rotated relative to the drill pipe 14 so that the threads in the bottom drill pipe 16*a* can engage with the threads in the drill pipe 14. During this operation, the cable 2 is held in tension. The winch-side cable section 2*a* is also slanted with respect to the upper drill pipe 16*b* because the sheave 6 must be hung off to the side to give the power drive 18 room to operate. During normal wireline operations, the sheave 6 is typically held directly above the rotary table 8. With the winch-side cable section 2*a* in this slanted position, the threads in the upper drill pipe 16*b* contact the wireline section 2*a* as the upper drill pipe 16*b* rotates. The effect is that the threads cut into the winch-side cable section 2*a*, reducing the tensile strength of the cable 2 at the contact area. As more stands of drill pipe are made up and connected to the drill pipe 14 in the wellbore using the process described above, the threads on the drill pipe repeatedly contact the winch-side cable section 2*a* in the same area, further weakening the cable 2 at the contact area. As the degradation continues, a point is reached where the cable 2 breaks. Thus, a mechanism is needed for protecting the cable 2 while connecting stands of drill pipe to the drill pipe in the wellbore.

SUMMARY OF THE INVENTION

In one aspect, the invention relates to a cable protector which comprises a housing body having a central bore. The housing is adapted to fit in a pipe connector. An insert body is rotatably supported in the central bore. The insert body has a groove which is adapted to receive a cable.

In some embodiments, a roller is rotatably supported in the groove. The cable rides on the roller when there is relative movement between the cable and the housing body. In some embodiments, a wall of the housing body includes an opening which provides access to the central bore of the housing body. In some embodiments, the housing body has a threaded end portion for engagement with a threaded pipe.

Other aspects and advantages of the invention will be apparent from the following description and the appended claims.

DETAILED DESCRIPTION OF THE INVENTION

Figure 1:
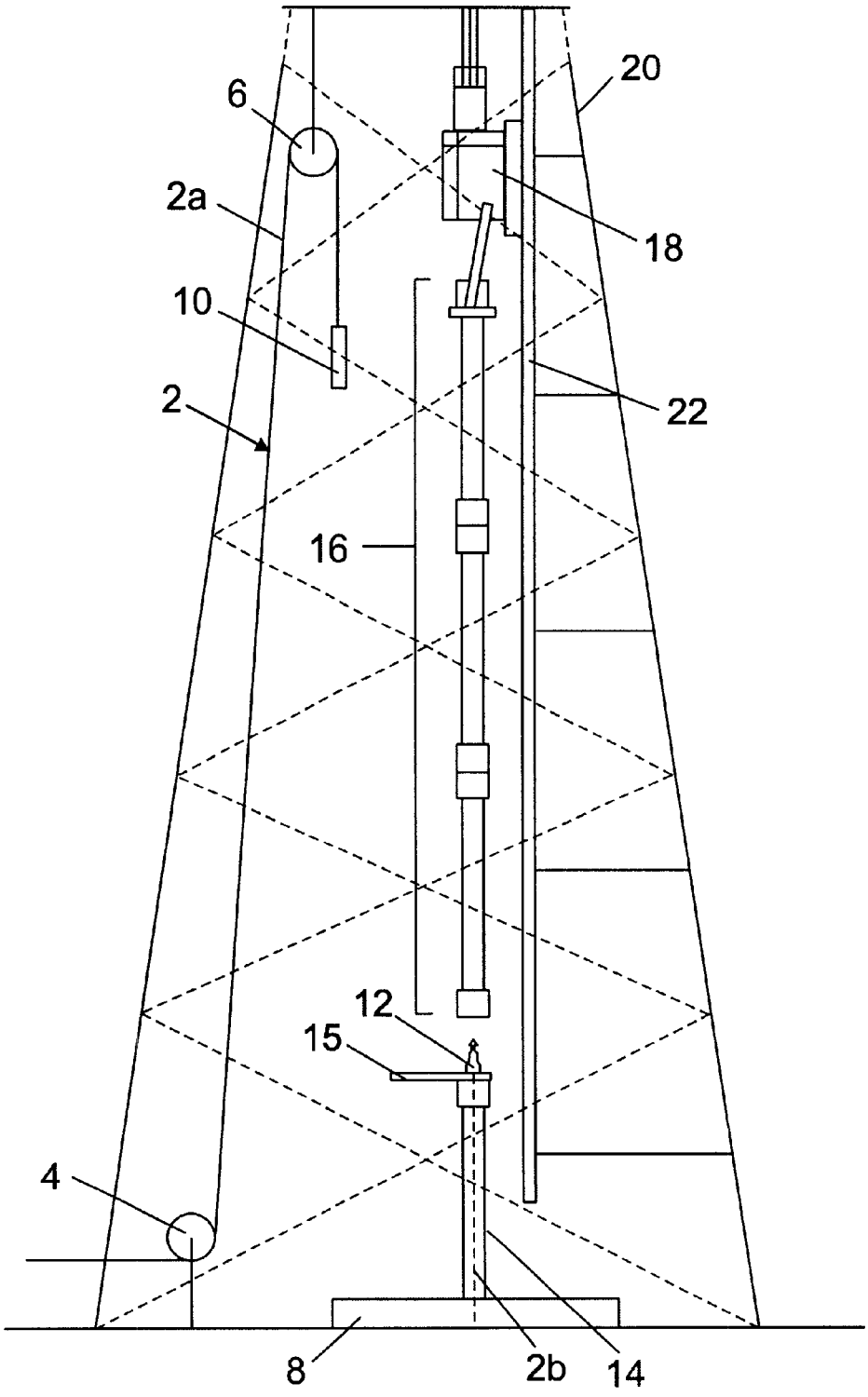
(PRIOR ART) FIGURE 1
FIGS. 1 and 2 illustrate a prior art setup for a fishing operation.
Figure 2:
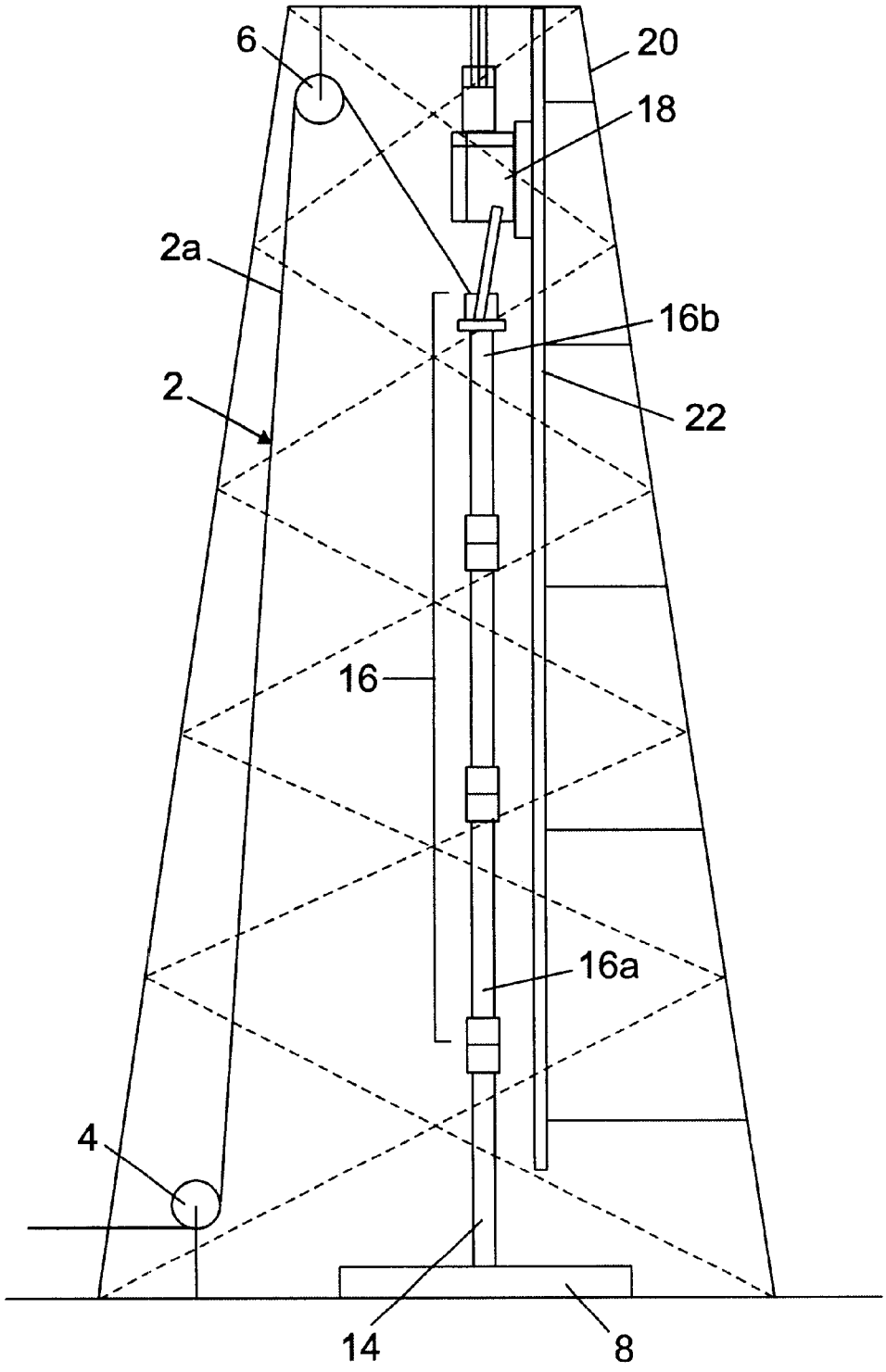
(PRIOR ART) FIGURE 2
Figure 3:
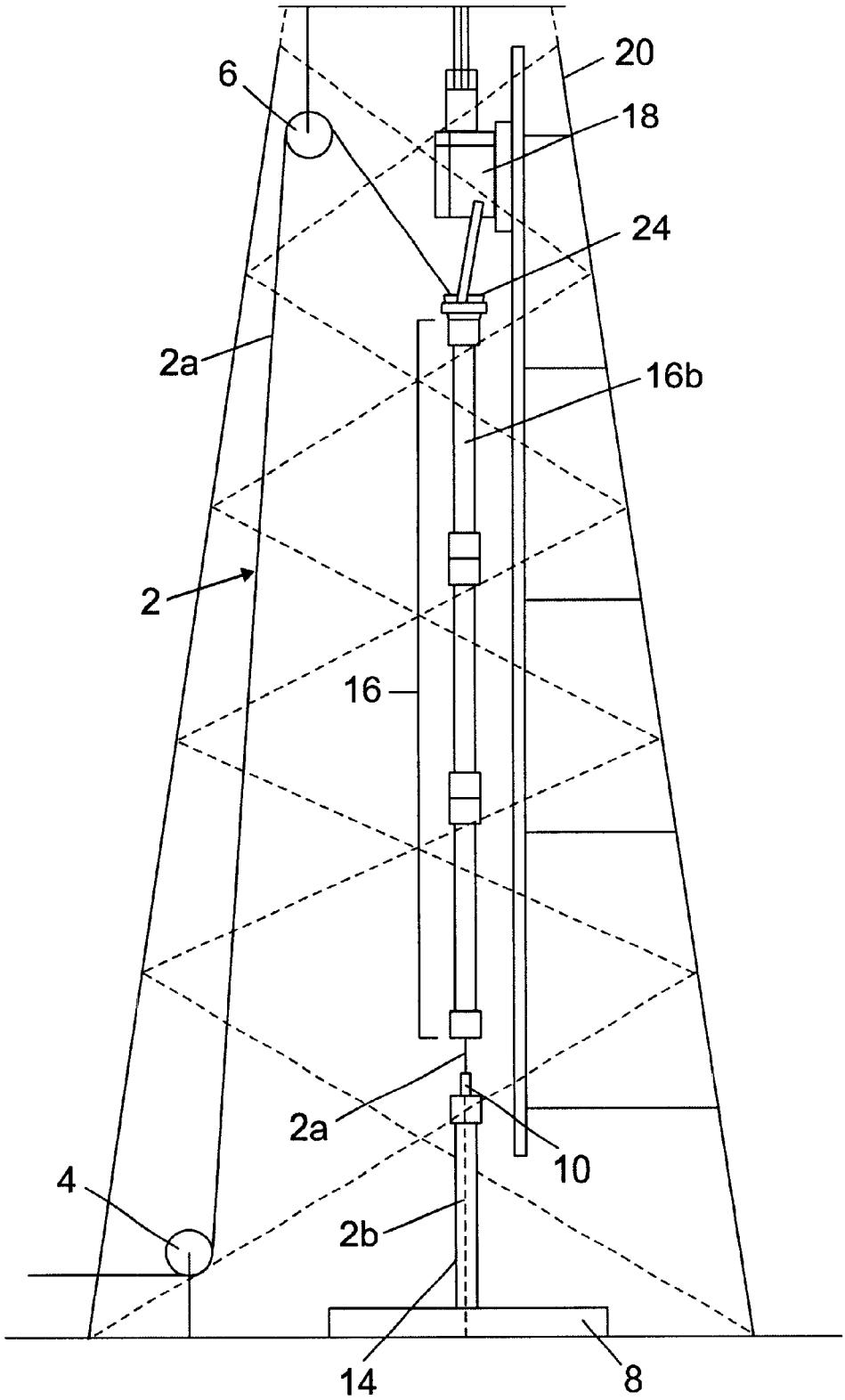
FIG. 3 illustrates a setup for a fishing operation in accordance with one embodiment of the invention.
Figure 4:
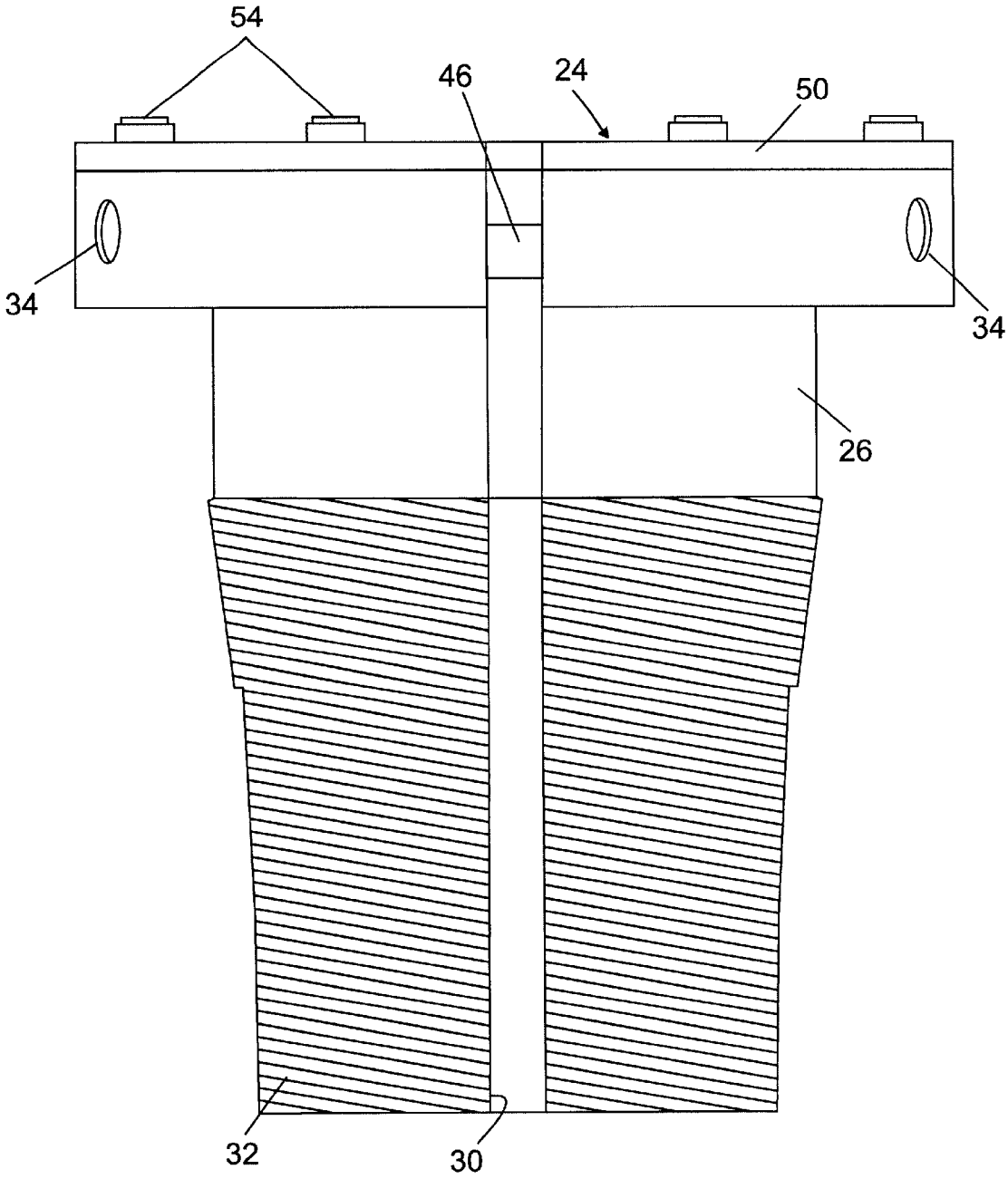
FIG. 4 is a front view of the cable protector shown in FIG. 3.
Figure 5:
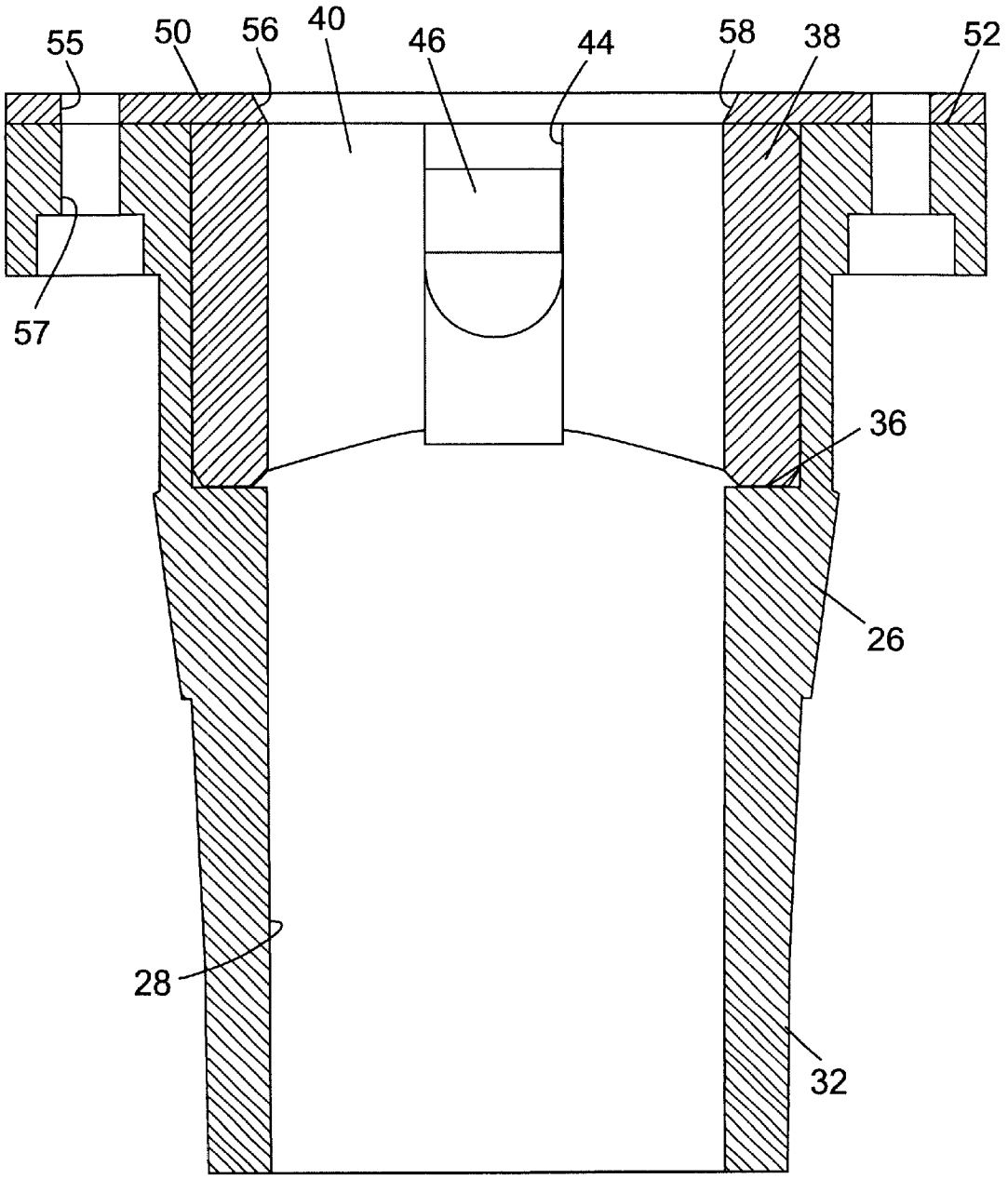
FIG. 5 is a vertical cross section of the cable protector shown in FIG. 4.

Various embodiments of the invention will now be described with reference to the accompanying figures. FIG. 3 shows a cable protector 24 installed on the drill pipe stand 16 (also previously shown in FIGS. 1 and 2). The purpose of the cable protector 24 is to protect the cable 2 (also previously shown in FIGS. 1 and 2) from damage as the drill pipe stand 16 is rotated. FIGS. 4 and 5 show an enlarged view and vertical cross section of the cable protector 24, respectively. As illustrated, the cable protector 24 includes a housing body 26 which is generally tubular in shape. The housing body 26 has a central bore 28 (shown in FIG. 5). An opening 30 is provided in the wall of the housing body 26. The opening 30 is connected to the central bore 28 and provides an entry into the central bore 28. The lower portion 32 of the housing body 26 includes threads for engaging with a drill pipe, e.g., the drill pipe 16*b* shown in FIG. 3. Apertures 34 are provided in the wall of the housing body 26 for engagement with handles (not shown). The handles facilitate handling of the housing body 26.

Figure 6A:
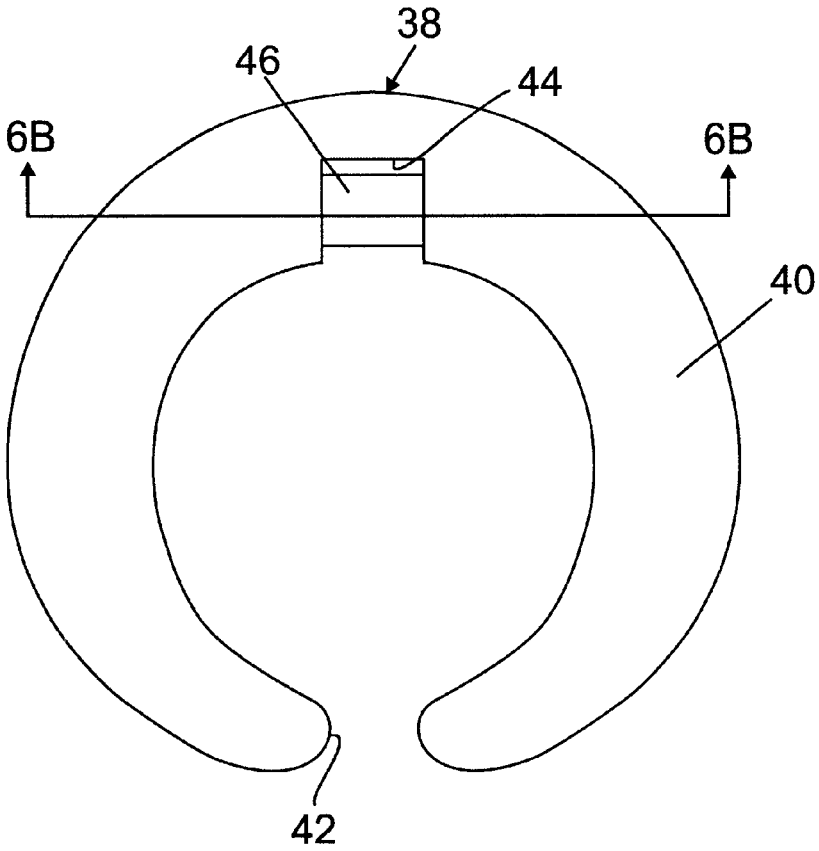
FIG. 6A is a top view of the insert shown in FIG. 5.
Figure 6B:
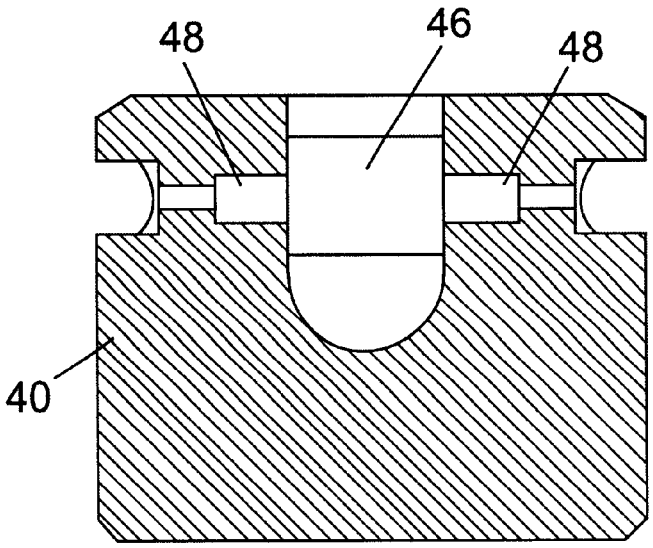
FIG. 6B is a cross section of the insert shown in FIG. 6A.

The housing body 26 has an inner shoulder 36. An insert 38 is supported on the inner shoulder 36. The insert 38 is supported so as to freely rotate relative to the housing body 26. A lubricant (not shown) is provided in between the housing body 26 and the insert 38 to reduce friction. FIG. 6A shows a top view of the insert 38. FIG. 6B shows a section through the insert 38. As shown in FIGS. 5, 6A, and 6B, the insert 38 includes an insert body 40 which is generally annular in shape. The insert body 40 has an opening 42 (shown in FIG. 6B) which can be aligned with the opening 30 (shown in FIG. 4) in the housing body 26. A groove 44 is provided in the insert body 40. In one embodiment, a roller 46 is rotatably supported in the groove 44. In one embodiment, the insert body 40 includes apertures 48 (shown in FIG. 6B) through which a pin (not shown), for example, can be inserted through the roller 46 to allow the roller 46 to rotate freely within the groove 44. Other means of rotatably supporting the roller 46 within the groove 44 can also be used.

A retaining plate 50 (shown FIG. 5) is mounted on the upper end 52 of the housing body 26 to retain the insert 38 within the housing body 26. The retaining plate 50 is secured to the housing body 26, for example, using bolts 54 (shown in FIG. 4) and nuts (not shown). The bolts 54 extend through apertures 55 in the retaining plate 50 and apertures 57 in the housing body 26. The retaining plate 50 has a bore 56 that is generally coaxial with the bore 28 of the housing body 26. The cable (such as 2 in FIG. 3) can be inserted into the housing body 26 through the bore 56 in the retaining plate 50. Preferably, the inner surface 58 of the retaining plate 50 is shaped such that it does not present a sharp edge to the cable (not shown). The inner surface 58 may be tapered or rounded, for example.

Returning to FIG. 3, the cable protector 24 is installed on the drill pipe stand 16. Initially, the drill pipe stand 16 is suspended above the drill pipe 14. The drill pipe 14 is supported by slips (not shown) in the rotary table 8. The cable section 2*a* is then threaded through the drill pipe stand 16 and connected to the cable section 2*b* extending through the drill pipe 14. Typically, the connection is made by engaging the overshot 10 attached to the winch-side cable section 2*a* with a spearhead (12 in FIG. 1) attached to the downhole-side cable section 2*b*. The cable section 2*a* is inserted into the drill pipe stand 16 through the insert 38 (shown in FIG. 5) of the cable protector 24. The insert body 40 (shown in FIG. 5) is rotated if necessary to ensure that the winch-side cable section 2*a* is positioned over the roller 46 (shown in FIG. 5) within the groove 44 (shown in FIG. 5).

Upon connecting the cable sections 2*a* and 2*b*, the drill pipe stand 16 is lowered onto the drill pipe 14 and rotated relative to the drill pipe 14 to make the threaded connection. As the drill pipe stand 16 rotates, the housing body 26 (shown in FIG. 5) also rotates because it is connected to the drill pipe stand 16. The winch-side cable section 2*a* rides on the roller 46 (shown in FIG. 5) in the groove 44 (shown in FIG. 5) and tends to keep the insert body 40 (shown in FIG. 5) stationary while the housing body 26 rotates relative to the insert body 40. In this way, contact is avoided between the winch-side cable section 2*a* and the drill pipe threads. After making the connection, the drill pipe stand 16 is lowered and the cable protector 24 is disengaged from the drill pipe stand 16. The opening 30 (shown in FIG. 4) in the housing body 26 and the opening 42 (shown in FIG. 6A) in the insert body 40 are then aligned to allow the cable protector 24 to be removed from the cable 2. The cable protector 24 can then be installed on another drill pipe stand.

The cable protector 24 has been described with respect to the winch-side cable section 2 riding on the roller 46 (shown in FIG. 5) as the housing body 26 (shown in FIG. 5) is rotated. In an alternate embodiment, the roller 46 may be removed from the groove 44, but the winch-side cable section 2*a* will remain in the groove 44 as the housing body 26 rotates. The insert body 40 may be made of a soft metal, such as copper or lead, so that it does not damage the winch-side cable section 2*a*.

The invention can provide general advantages. By installing the cable protector on a drill pipe stand and allowing the cable to ride on the roller as the drill pipe stand rotates, the possibility of cutting the cable is reduced because the cable no longer contacts the threads in the drill pipe.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A cable protector, comprising:

a housing body adapted to fit in a pipe connector and having a central bore, wherein the surface of the central bore includes a bearing surface therein; and an insert body rotatably supported on the bearing surface in the central bore, the insert body having a groove adapted to fit a cable therein.

2. The cable protector of claim 1, further comprising a roller rotatably supported in the groove, wherein the cable rides on the roller when there is relative movement between the cable and the housing body.

3. The cable protector of claim 1, wherein a wall of the housing body includes an opening which provides access to the central bore of the housing body.

4. The cable protector of claim 1, further comprising a retaining plate mounted on the housing body for retaining the insert body within the housing body.

5. The cable protector of claim 1, wherein the housing body has a threaded end portion for engagement with a threaded pipe.

6. A cable protector, comprising:

a housing body having a central bore, the housing body adapted to fit in a pipe connector;

an insert body rotatably supported in the central bore, the insert body having a groove adapted to fit a cable therein; and a roller rotatably supported in the groove, wherein the cable rides on the roller when there is relative movement between the cable and the housing body.

7. The cable protector of claim 6, wherein a wall of the housing body includes an opening which provides access to the central bore of the housing body.

8. The cable protector of claim 6, further comprising a retaining plate mounted on the housing body for retaining the insert body within the housing body.

9. The cable protector of claim 6, wherein the housing body has a threaded end portion for engagement with a threaded pipe.

10. A cable protector, comprising:

a housing body having a central bore and an opening providing access to the central bore, the housing body adapted to fit in a pipe connector;

an insert body rotatably supported in the central bore, the insert body having a groove adapted to fit a cable therein; and a roller rotatably supported in the groove, wherein the cable rides on the roller when there is relative movement between the cable and the housing body.

* * * * *